US005230596A

United States Patent [19]

Morad

[11] Patent Number: 5,230,596

[45] Date of Patent: Jul. 27, 1993

[54] SLIDABLE AND THREADABLE QUICK RELEASE LOCKING NUT FOR QUICK CHANGE TYPE MOP HOLDERS

[75] Inventor: Fred I. Morad, Toluca Lake, Calif.

[73] Assignee: Worldwide Integrated Resources, Inc., Glendale, Calif.

[21] Appl. No.: 12,517

[22] Filed: Feb. 2, 1993

[51] Int. Cl.[5] ..... F16B 37/08; A47L 13/20

[52] U.S. Cl. ..... 411/433; 411/437; 411/941.1; 15/153

[58] Field of Search ..... 411/432, 433, 437, 324, 411/940, 941, 941.1; 15/151, 153

[56] References Cited

U.S. PATENT DOCUMENTS

| | | | |
|---|---|---|---|
| 422,361 | 4/1890 | Alton . | |
| 499,402 | 6/1893 | Stewart . | |
| 756,385 | 4/1904 | Look . | |
| 786,576 | 4/1905 | Look . | |
| 900,843 | 10/1908 | Folberth . | |
| 923,282 | 6/1909 | Look . | |
| 1,174,550 | 3/1916 | Dobbins . | |
| 1,193,865 | 8/1916 | Brown . | |
| 1,611,033 | 12/1926 | Hill et al. . | |
| 1,728,845 | 9/1929 | Wellington . | |
| 2,118,361 | 5/1938 | Schaeffer, Jr. . | |
| 2,305,352 | 12/1942 | Helminiak . | |
| 2,328,287 | 8/1943 | Martin . | |
| 2,346,728 | 4/1944 | Carlson | 411/433 X |
| 2,692,403 | 10/1954 | Friar . | |
| 2,724,852 | 11/1955 | Clark . | |
| 2,900,652 | 8/1959 | Kautenberg . | |
| 4,787,794 | 11/1988 | Guthrie | 411/433 |
| 4,963,656 | 9/1987 | Guthrie . | |

FOREIGN PATENT DOCUMENTS

| | | |
|---|---|---|
| 172308 | 12/1934 | Switzerland . |
| 654807 | 3/1979 | U.S.S.R. . |

*Primary Examiner*—Neill R. Wilson

*Attorney, Agent, or Firm*—Thomas I. Rozsa; Dong Chen

[57] ABSTRACT

The present invention is an improved quick release locking nut for quick change type mop holders. The mop holder has a frame attachable to a mop stick and a clamping member for securing mop fill. The quick release locking nut is slidably mounted on a central shank of the frame, and has a pivotally mounted pawl which is biased by a spring. The inner screw threads on the tip of the pawl are engaged with the outer screw threads on the central shank, in order to lock the quick release locking nut on the central shank for preventing the clamping member from sliding on the central shank. When the pawl is pressed against the spring and its tip is disengaged from the central shank, the quick release locking nut is unlocked and can be slid on the central shank for allowing the clamping member to slide on the central shank so that the mop clamp can be released.

20 Claims, 2 Drawing Sheets

FIG. 1
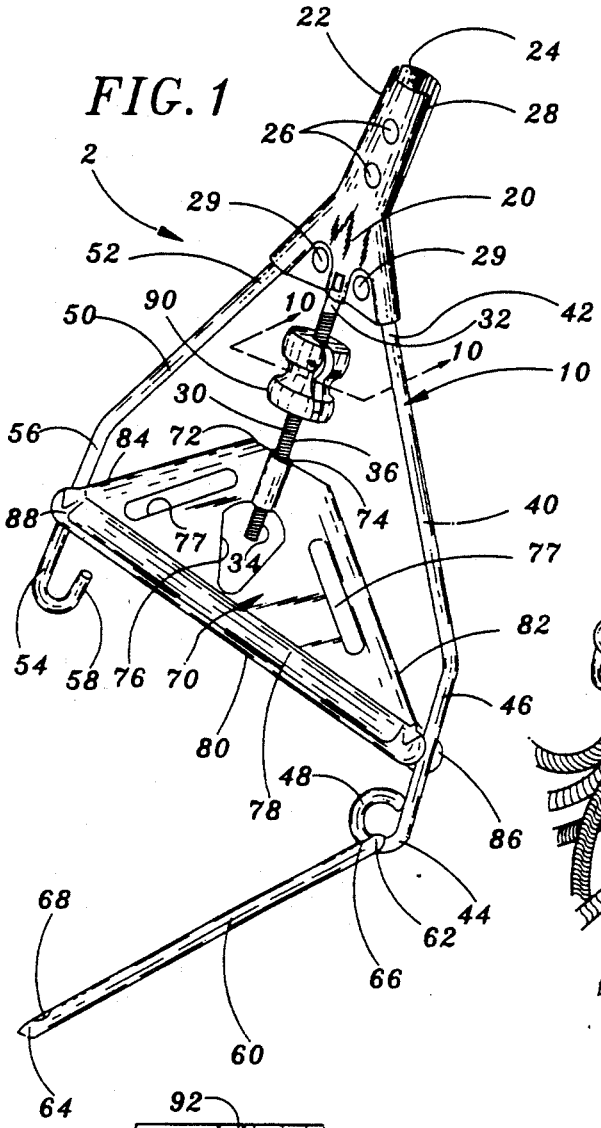
FIG. 2
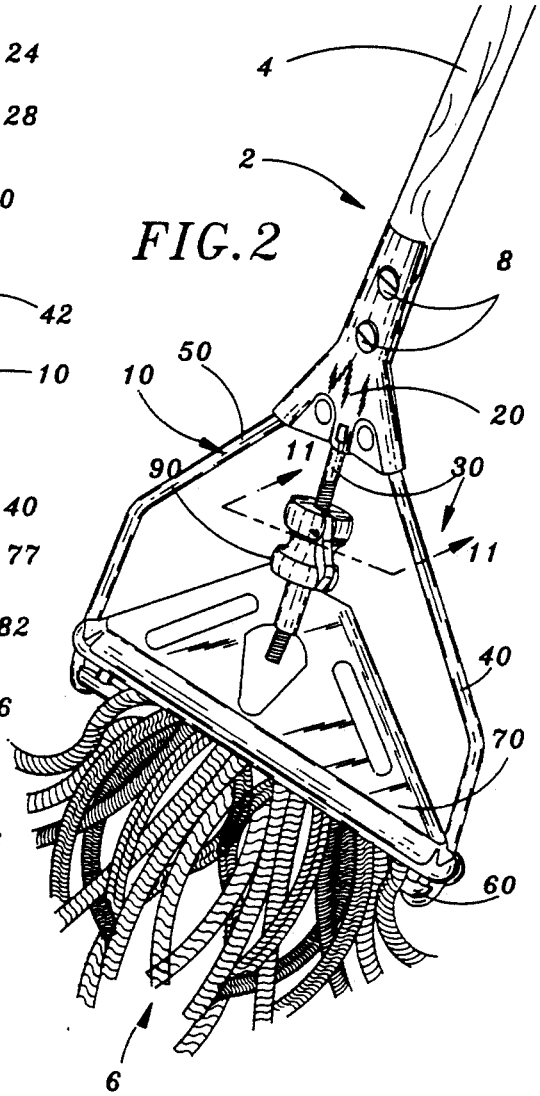
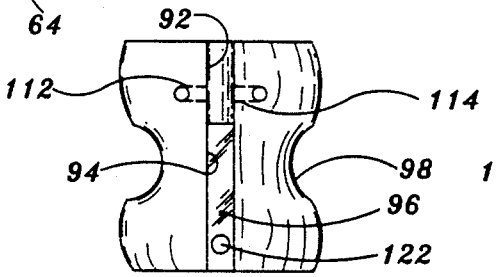
FIG. 4
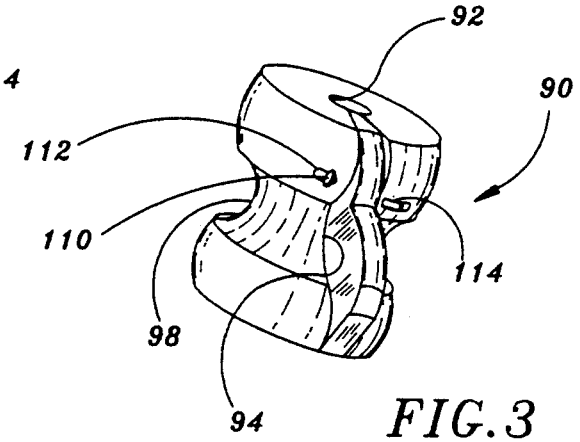
FIG. 3

FIG. 5
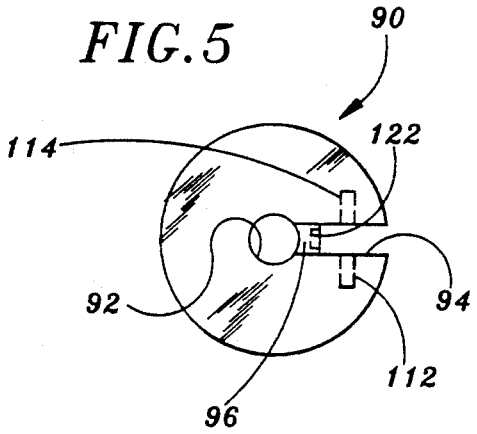
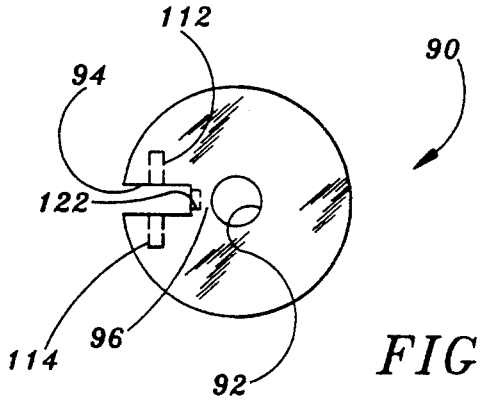
FIG. 6
FIG. 7
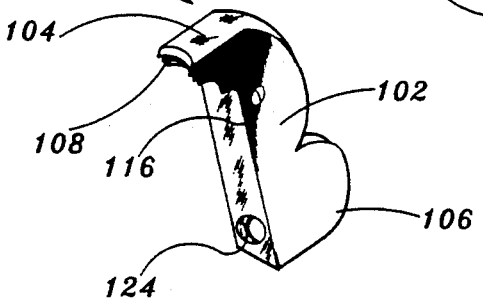
FIG. 8
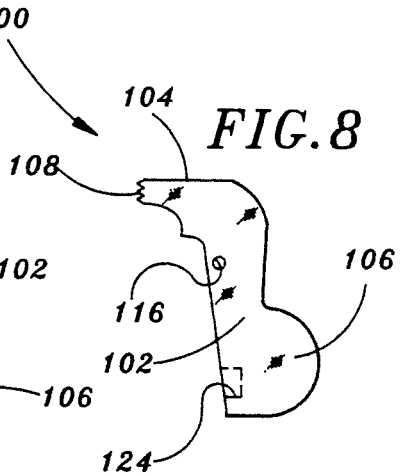
FIG. 9
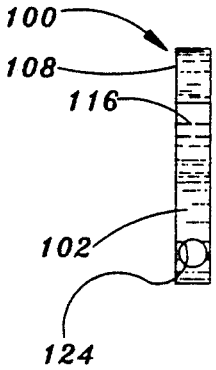
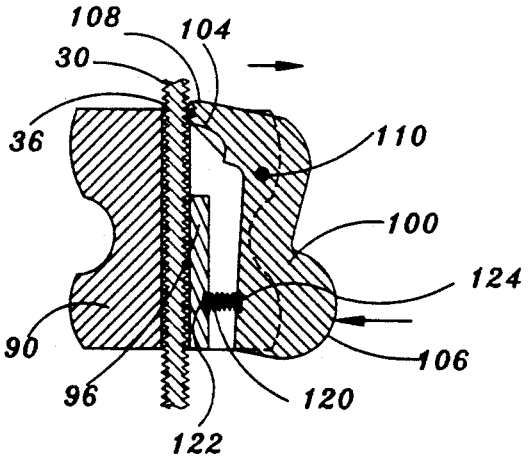
FIG. 10
(Section on line 10 - 10)
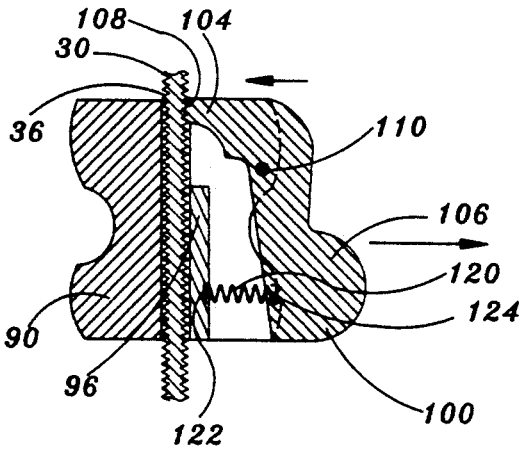
FIG. 11
(Section on line 11 - 11)

SLIDABLE AND THREADABLE QUICK RELEASE LOCKING NUT FOR QUICK CHANGE TYPE MOP HOLDERS

BACKGROUND OF THE INVENTION

1. Field of the Invention

The present invention relates to the field of mop holders. More particularly the present invention relates to the field of mop holders adaptable to mop sticks and having adjustable clamps.

2. Description of the Prior Art

The following nineteen (19) patents were uncovered as being the most relevant prior art relating to the present invention:

1. U.S. Pat. No. 422,361 issued to Alton on Mar. 4, 1890 for "Screw Nut" (hereafter the "Alton Patent").

2. U.S. Pat. No. 499,402 issued to Stewart on Jun. 13, 1893 for "Mop" (hereafter the "Stewart Patent").

3. U.S. Pat. No. 756,385 issued to Look on Apr. 5, 1904 for "Mop or Brush Holder" (hereafter the "first Look Patent").

4. U.S. Pat. No. 786,576 issued to Look on Apr. 4, 1905 for "Mop or Brush Holder" (hereafter the "second Look Patent").

5. U.S. Pat. No. 900,843 issued to Folberth on Oct. 13, 1908 for "Quick Release Nut" (hereafter the "Folberth Patent").

6. U.S. Pat. No. 923,282 issued to Look on Jun. 1, 1909 for "Mop and Brush Holder" (hereafter the "third Look Patent").

7. U.S. Pat. No. 1,174,550 issued to Dobbins on Mar. 7, 1916 for "Mop Holder" (hereafter the "Dobbins Patent").

8. U.S. Pat. No. 1,193,865 issued to Brown on Aug. 8, 1916 for "Dust Cap for Valve Stems" (hereafter the "Brown Patent").

9. U.S. Pat. No. 1,611,033 issued to Hill et al. on Dec. 14, 1926 for "Mop" (hereafter the "Hill Patent").

10. U.S. Pat. No. 1,728,845 issued to Wellington on Sep. 17, 1929 for "Combination Brush and Mop Holder" (hereafter the "Wellington Patent").

11. U.S. Pat. No. 2,118,361 issued to Schaeffer, Jr. on May 24, 1938 for "Quick Action Nut" (hereafter the "Schaeffer Patent").

12. U.S. Pat. No. 2,305,352 issued to Helminiak on Dec. 15, 1942 for "Mop Head" (hereafter the "Helminiak Patent").

13. U.S. Pat. No. 2,328,287 issued to Martin on Aug. 31, 1943 for "Holder for Mops and Other Articles" (hereafter the "Martin Patent").

14. U.S. Pat. No. 2,692,403 issued to Friar on Oct. 26, 1954 for "Means for Removably Securing Mopheads to Handles" (hereafter the "Friar Patent").

15. U.S. Pat. No. 2,724,852 issued to Clark on Nov. 29, 1955 for "Mop Stick Clamp" (hereafter the "Clark Patent").

16. U.S. Pat. No. 2,900,652 issued to Kautenberg on Aug. 25, 1959 for "Quick Change Mop Holder with Outer Hinged Jaw" (hereafter the "Kautenberg Patent").

17. U.S. Pat. No. 4,963,656 issued to Guthrie on Sep. 15, 1987 for "Quick Adjusting Nut" (hereafter the "Guthrie Patent").

18. Swiss Patent No. 172,308 issued to Ammann on Dec. 17, 1934 (hereafter the "Swiss Patent").

19. Russian Patent No. 654,807 issued to Dombrovskii on Mar. 30, 1979 (hereafter the "Russian Patent").

The Alton Patent discloses a screw nut. The screw nut is designed for securing the position of a fuse-box "B". It includes a nut "N" and a thumb-piece "T" which is threaded. The nut "N" has a vertical hole for sliding over a screw "S" and a horizontal hole for receiving the thumb-piece "T". The thumb-piece "T" has a threaded hole for engagement with the screw "S". It is secured to the nut "N" by a limiting screw "M" and further biased by a spring W.

The Stewart Patent discloses a mop comprising a stick "A" and a T-shaped head "B". Head "B" is attached to an end of stick "A" and has a transverse portion that serves as part of a clamp. A U-shaped wire "C" has a transverse portion that is parallel to the transverse portion of head "B" and serves as the other part of the clamp, and two oppositely disposed portions extend backwardly which converge to stick "A" and are pivotally attached to a lever "D". Lever "D" is forked to straddle stick "A" and pivotally attached to a ring "E" that is slidably linked on stick "A". A spiral spring "F" is wound on stick "A" between head "B" and ring "E", such that its expensive tendency holds the clamp closed when lever "D" is thrown back.

The first Look Patent discloses a mop or brush holder having a similar structure as the Stewart Patent. It comprises a handle "a", a clamp-head "b", a clamp-jaw "d", a lever "h", and a pawl "l" having an annular part "l" surrounding handle "a". Clamp-head "b" is mounted upon one end of handle "a" and forms a clamp with a straight part "d'" of clamp-jaw "d". The side of clamp-jaw "d" are curved in a bow shape with their ends pivotally mounted to a lever "h" that is interconnected with pawl "l". This is different from the Stewart Patent in that instead of using a spring, it uses a ratchet "n" mounted on handle "a" between clamp-head "b" to fasten the clamp. When lever "h" is pressed down to fasten the clamp, pawl "l" engages the ratchet-teeth.

The second Look Patent discloses a different mop or brush holder. The second Look Patent is different from the First Look Patent in that instead of using a pawl having an annular part surrounding the handle, it uses a pawl "d" and does not have an annular part surrounding the handle, but having parallel bars "d'" and "d'" sliding between the handle and a retainer "b'" of the ratchet.

The Folberth Patent discloses a quick release nut. The quick release nut is a wing nut having a fixed wing and a pivoted wing. The pivoted wing can be rotated between an engaged position and a disengaged position.

The third Look Patent discloses a further different mop or brush holder. The primary object of the third Look Patent is to make the various parts of the mop or brush holder in a manner to permit rapid assembly. The structure of the third Look Patent is similar to the first Look Patent. The difference is that the pawl and the lever of the third Look Patent are detachable.

The Dobbins Patent discloses a mop holder comprising a head member attached to a handle member, and a T-shaped clamp having an extended shank connected to a lever. The lever is pivotally mounted to the handle member and has ratchet-teeth. A loop is pivotally mounted further distally on the handle member such that when the lever is pulled to swing backward, the loop can engage the ratchet-teeth of the lever to fasten the clamp.

The Brown Patent disclosed a dust cap for valve stems. The dust cap includes two clamping arms which can be pivoted by their respective finger pieces. The lower ends of the clamping arms have inner screw threads for engagement with the valve stem.

The Hill Patent discloses a mop. The mop has a removable supporting rod for the mop cloth or fill. It also includes a wing nut for locking a triangular shaped brace member.

The Wellington Patent discloses a combination brush and mop holder. It comprises a lever 18 pivotally mounted to a handle 1. Similar to the lever of the Dobbins Patent, lever 18 has a series of ratchet notches 20. The difference is that lever 18 is retained in a fastened position by a hook 23 mounted on handle 1, and its ratchet notches 20 are used for engaging the loop end of mop clamping yoke 8.

The Schaeffer Patent disclose a quick action nut. The quick action nut is designed for a paint agitating machine which includes a stationary clamping member and an adjustable clamping member. The quick nut is readily slipped over a threaded rod to a clamping position and then threaded to engage the adjustable clamping member to the stationary clamping member.

The Helminiak Patent discloses a mop head. The mop head includes an inner clamp and a frame having an outer clamp. The inner clamp is biased by a coil spring towards the outer clamp bar of the frame.

The Martin Patent discloses a holder for mops and other articles. The holder includes two jaws. One jaw is integral with a supporting member. The other jaw is mounted for angular movement on a fulcrum of the support member. The holder further includes a clutch device for adjusting the movable jaw.

The Friar Patent discloses a means for removably securing mopheads to handles. The mophead includes an outer frame having a removable cross member, and an inner frame locked by a wing nut.

The Clark Patent discloses a mop stick clamp designed for use with a conventional mop stick. It comprises a T-shaped clamping frame member 13, a lever member 28, a pair of rods 31 and 32, a coil spring 26 and a clamping bar 21. One end of coil spring 26 is attached to frame member 13, and the other end to lever 28. Each rod 31 and 32 has one end interconnected with lever 28 and the other end hook-shaped for adapting clamping bar 21.

The Kautenberg Patent discloses a quick change mop holder with outer hinged jaw. The quick change mop holder includes a one piece bail, a hinged cross bar, a clamping head, and a wing nut which is threaded on a central screw bar for locking the clamping head. The one-piece bail and the central rod are secured to a stick by a sheet metal socket. The major disadvantage of the wing nut utilized in the Kautenberg Patent is that the wing nut has to be rotated many turns for traveling a required distance along the screw bar to release or fasten the clamping head. This not only slows down the process of installing or replacing a mop, but also makes it hard to use for people having little strength in their hands, especially elderly people.

The Guthrie Patent discloses a quick adjusting nut. The quick adjusting nut is designed for a conventional milling machine. It includes a nut body 24, a depressible button element 26, and a compression spring 28. The limitation of the quick adjusting nut utilized in the Guthrie Patent is that its three components, the nut body, the depression button and the compression spring, will become loosened apart once the locking member is not mounted on a threaded shank.

The Swiss Patent discloses mop head. The mop head includes an outer frame and an inner frame. The inner frame is locked by a wing nut.

The Russian Patent discloses a quick release locking nut engageable to a screw rod. The quick release locking nut is not designed to be slid nor rotated on the screw rod. Instead it is the screw rod which is going to be slid or rotated. Accordingly the body shape of the quick release locking nut is not designed to be easily and firmly griped by hand. The cross-sectional view in FIG. 3 of the Dombrovskii Patent shows that the quick release locking nut has an asymmetrical body shape, which is similar to a single wing nut. This single-wing shaped body is primarily not suitable for being handled and is only acceptable when the nut is not designed to be slid or rotated anyway. Moreover, this single-wing shaped configuration would be worse than a double-wing shaped nut. This is because to rotate the double-wing quick release locking nut, a user may place two fingers on the locking member, each on a respective wing of the double-wing shaped locking member. There is only one wing on the quick release locking nut of the Russian Patent for merely one of the user's fingers to rest on. It makes it harder to rotate the quick release locking nut, particularly for people with less strength in their hand.

The above discussed prior art patents disclose many common components and features of mop holders. However, the locking and releasing mechanisms utilized in the prior art mop holders are often undesirable for people with less strength on their hands, especially elderly people, because they usually find the lever hard to operate. For example, the commonly used wing nut often requires many turns. On the other hand none of the quick nuts designed for other machinery is suitable for mop holders.

It is desirable to have a new mop holder where the clamp locking mechanism can be securely fastened and quickly released. Ther is a significant need for a mop holder which is easy to use, especially for elderly people without much strength and where the clamp locking mechanism is not attached to the mop stick, so any kind of mop stick can be interchangeably adapted.

SUMMARY OF THE INVENTION

The present invention is an improved slidable and threadable quick release quick release locking nut for quick change type mop holders.

It is known that a prior art adjustable mop holder typically has a fixed T-shaped head member and a movable wire frame. The base portion of the T-shaped head member is adaptable to a mop stick, and the straight edge of the transverse portion of the T-shaped head member serves as the fixed one of the two opposite members of a mop clamp. The movable wire frame often has two elongated side portions supporting a straight transverse portion that serves as the movable one of the two opposite members of the mop clamp. The movable wire frame is coupled to a lever and is fastened either by a biasing spring or by a ratchet bar mechanism, where both are mounted to the mop stick.

It has been discovered, according to the present invention, that it does not matter whether the wire of a mop holder is movable or fixed, as long as one of the two opposite members of a mop clamp is movable and the other one is fixed. Therefore the mop holder may have a fixed wire frame and a movable clamping member, where the fixed wire frame has a transverse rod serving as the fixed one of two opposite members of the mop clamp, and the movable clamping member has a transverse edge serving as the other movable one of the two opposite members of the mop clamp. The transverse rod of the fixed wire frame may be supported by two opposite side rods converging to a base portion, which accommodates a mop stick.

It has also been discovered, according to the present invention, that if the fixed wire frame has a central rod, then the movable clamping member can be slidably supported by the central rod of the fixed frame, such that the distance between the transverse edge of the movable clamping member and the transverse portion of the fixed wire frame is adjustable for adapting different sized mops. Therefore no moving part of the mop holder is attached to the mop stick, which makes the mop holder adaptable to any type of mop sticks.

It has further been discovered, according to the present invention, that the movable clamping member of the mop holder may be locked by a quick release locking nut that is also slidably mounted to the central rod of the fixed wire frame and next to the movable member. Therefore a lever locking member is eliminated, and since the quick release locking nut is also slidable, it will allow fast release movement of the movable clamping member.

It has additionally been discovered, according to the present invention, that a spring biased pawl may be pivotally mounted inside the quick release locking nut, such that the pivoted pawl is biased by a coil spring to engage to the central rod of the fixed wire frame for locking the movement of the quick release locking nut. Therefore a user may simply press the pawl against the coil spring to disengage it from the central rod of the fixed wire frame to unlock the movement of the quick release locking nut.

It has further been discovered, according to the present invention, that if the central rod of the fixed wire frame has outer screw threads and the engaging tip of the spring biased pawl of the quick release locking nut has inner screw threads, then when the spring biased pawl of the quick release locking nut is engaged to the central rod of the fixed wire frame, the quick release locking nut can be threaded on the central rod of the fixed wire frame to further adjust the tightness of the mop clamp.

It is therefore an object of the present invention to provide an improved slidable and threadable quick release locking nut for a quick change type mop holder having a fixed wire frame that has a transverse rod serving as the fixed one of two opposite members of the mop clamp, where the transverse rod is supported by two opposite side rods converging to a base portion for accommodating a mop stick, and a movable clamping member that has a transverse edge serving as the other movable one of the two opposite members of the mop clamp.

It is also an object of the present invention to provide an improved slidable and threadable quick release locking nut for a quick change type mop holder having a fixed wire frame that also has a central rod, such that the movable clamping member can be slidably supported by the central rod of the fixed frame for adjusting the distance between the transverse edge of the movable clamping member and the transverse portion of the fixed wire frame to suit different sized mops, so that any type of standard mop stick can be interchangeably used with the mop holder because there is no moving part of the mop holder attached to the mop stick.

It is a further object of the present invention to provide an improved slidable and threadable quick release locking nut for fastening the movable clamping member of a quick change type mop holder, where the quick release locking nut is also slidably mounted to the central rod of the fixed wire frame and next to the movable member to allow fast release movement of the movable clamping member, so that there is no need for a lever locking member for fastening the movable clamping member.

It is an additional object of the present invention to provide an improved slidable and threadable quick release locking nut, where the quick release locking nut is provided with a pivotally mounted and spring biased pawl, such that when the tip of the pawl is engaged to the central rod of the fixed wire frame by the spring, it locks the movement of the quick release locking nut. However, by simply pressing the pawl against the coil spring, a user can free the movement of the quick release locking nut, which in turn frees the movement of the movable clamping member.

It is a further object of the present invention to provide an improved slidable and threadable quick release locking nut, where outer screw threads are provided on the central rod of the fixed wire frame, and inner screw threads are provided on the engaging tip of the spring biased pawl of the quick release locking nut, so that as the spring biased pawl of the quick release locking nut is engaged to the central rod of the fixed wire frame, the quick release locking nut can be further threaded on the central rod of the fixed wire frame to precisely adjust the tightness of the mop clamp.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention improved slidable and threadable quick release quick release locking nut for quick change type mop holders, where the mop holder is in its released position.

FIG. 2 is a perspective view of the present invention improved slidable and threadable quick release quick release locking nut for quick change type mop holders, where the mop holder is in its fastened position.

FIG. 3 is a perspective view of the present invention improved slidable and threadable quick release locking nut.

FIG. 4 is a side view of the present invention improved slidable and threadable quick release locking nut.

FIG. 5 is a top view of the present invention improved slidable and threadable quick release locking nut.

FIG. 6 is a bottom view of the present invention improved slidable and threadable quick release locking nut.

FIG. 7 is a perspective view of the pawl of the present invention improved slidable and threadable quick release locking nut.

FIG. 8 is a side view of the pawl of the present invention improved slidable and threadable quick release locking nut.

FIG. 9 is a front view of the pawl of the present invention improved slidable and threadable quick release locking nut.

FIG. 10 is a cross-sectional view taken along dotted line 10—10 of FIG. 1 showing that the spring biased pawl of the present invention improved slidable and threadable quick release locking nut is disengaged from the central rod of the fixed frame of the mop holder.

FIG. 11 is a cross-sectional view taken along dotted line 10—10 of FIG. 1 showing that the spring biased pawl of the present invention improved slidable and threadable quick release locking nut is engaged from the central rod of the fixed frame of the mop holder.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The principal advantage of the present invention is that it provides an improved slidable and threadable quick release locking nut for a quick change type mop holder which is easy and quick to use, particularly for elderly people who do not have much strength. In addition, the quick release locking nut is specially designed and constructed for the quick change type mop holders, so it is suitable to the environment related to the usage of mops.

Referring to FIGS. 1 and 2, there is shown the present invention quick release locking nut used on a quick change type mop holder 2 which can be interchangeably adapted to a mop stick 4 and adjustably clamped to a mop 6. The mop holder 2 has a generally triangular shaped fixed frame 10 as its basic structure. The fixed frame 10 is constructed by a base 20, a central shank 30, two oppositely disposed side rods 40 and 50, and a transverse rod 60. The base 20 is a generally yoke shaped piece having a rearwardly elongated portion 22 for interchangeably adapting the mop stick 4. The rearwardly elongated portion 22 is generally tubular shaped and typically has a hollow chamber 24 for receiving an end of the mop stick 4. Several transverse apertures 26 may be provided for accommodating fastening pins 8 to secure the mounting of the mop stick 4. The rearwardly elongated portion 22 may be further split along one or more side slits 28 so it can adapt mop sticks with various thickness. A couple of apertures 29 may be provided on the base 20 to reduce its weight. The base 20 may have other types of configurations that are suitable for adapting mop sticks.

The central shank 30 has a rear end 32 and a front end 34. The rear end 32 is attached to the middle of the base 20, and the front end 34 extends forwardly. The central shank 30 is further provided with outer screws threads 36 along a substantial portion of its length. The first side rod 40 has a rear end 42 and a front end 44. The rear end 42 is attached to one side of the base 20, and the front end 44 extends forwardly and outwardly beyond the central shank 30. Similarly, the second side rod 50 also has a rear end 52 and a front end 54, where the rear end 52 is attached to the other side of the base 20, and the front end 54 extends forwardly and outwardly beyond the central shank 30. The first side rod 40 and the second side rod 50 are oppositely disposed. It is preferable to have the central shank 30, the first side rod 40 and the second side rod 50 all aligned in a same plane. A front portion 46 adjacent to the front end 44 of the first side rod 40 is made parallel to the central shank 30, and a front portion 56 adjacent to the front end 54 of the first side rod 50 is also made parallel to the central shank 30. Furthermore, a closed loop 48 is provided at the front end 44 of the first side rod 40, and an open loop 58 is provided at the front end 54 of the second side rod 50. The purposes of these detailed configurations will be introduced later.

The transverse rod 60 has a first end 62 and a second end 64. The length of the transverse rod 60 should be about the same as the distance between the front end 44 of the first side rod 40 and the front end 54 of the second side rod 50, such that the transverse rod 60 can be supported by the front end 44 of the first side rod 40 and the front end 54 of the second side rod 50. When the transverse rod 60 is supported by the front end 44 of the first side rod 40 and the front end 54 of the second side rod 50, it is disposed beyond the central shank 30. In other words, there is a distance between the front end 34 of the central shank 30 and the transverse rod 60. The transverse rod 60 serves as a fixed member of the two opposite members of a mop clamp.

A small opening or loop 66 is provided at the first end 62 of the transverse rod 60, and a small opening or loop 68 is provided at the second end 64 of the transverse rod 60. The first end 62 of the transverse rod 60 can be hingeably attached to the front end 44 of the first side rod 40 by interlinking the small opening or loop 66 at the first end 62 of the transverse rod 60 with the closed loop 48 at the front end 44 of the first side rod 40. The second end 64 of the transverse rod 60 can be releasably attached to the front end 54 of the second side rod 50 by interlinking the small opening or loop 68 at the second end 64 of the transverse rod 60 with the open loop 58 at the front end 54 of the second side rod 50. The purpose of this arrangement is that a user can quickly detach the second end 64 of the transverse rod 60 from the front end 54 of the second side rod 50 without having the transverse rod 60 completely separated from the mop holder frame 10. Since the first end 62 of the transverse rod 60 is still hinged to the front end 44 of the first side rod 40, the user does not need to worry about having the transverse rod 60 lost. This attachment also enables the user to have the mop 6 easily installed onto or removed from the mop holder 2. This attachment further enables the user to have the clamping member 70 and the quick release locking nut 90 easily assembled onto or dissembled from the central rod 30 for cleaning or maintenance purposes.

The clamping member 70 is generally triangular in shape. At its rear edge 72 there is a central hole for receiving the central shank 30, such that the clamping member 70 can be slidably mounted onto the central shank 30. A central aperture 76 is provided for rendering the needed space for the front end 34 of the central shank 30 so that the clamping member 70 may move back and forth on the central shank 30. A couple of apertures 77 may be provided for reducing the weight of the clamping member 70.

The clamping member 70 further has a transverse front edge 78 serving as the movable member of the two opposite members of the mop clamp, a first side edge 82 engaged with the first side rod 40, and an oppositely disposed second side edges 84 engaged with the second side rod 50. As the clamping member 70 is slidably mounted on the central shank 30, its transverse edge 78 is disposed adjacent to the transverse rod 60. It is understood that one of the essential features of a mop holder is to provide an adjustable mop clamp. A clamp is basically constituted by two oppositely disposed members. For an adjustable clamp, at least one of its two oppositely disposed members needs to be relatively movable. In the mop holder, the transverse rod 60 serves as the fixed member of the two oppositely disposed members of a mop clamp, and the transverse front edge 78 of the clamping member 70 serves as the movable member of the two oppositely disposed members of the mop clamp. As the clamping member 70 slides back and forth on the central shank 30, the distance between its transverse front edge 78 and the transverse rod 60 is varying, which allows installing or removing of the mop 6.

The transverse front edge 78 of the clamping member 70 may be further widened for accommodating a mop attachment. As the mop strips 6 are placed between the transverse rod 60 of the mop frame 10 and the transverse front edge 78 of the clamping member, the widened transverse front edge 78 increases the contacting area with the mop strips 6, so that the mop attachment is more secure. The transverse front edge 78 of the clamping member 70 may be widened in various ways. For example, it may be widened directly, i.e., increase the thickness of the triangular shaped clamping member; or, as incorporated in the preferred embodiment of the present invention, it may be widened by providing two oppositely disposed transverse flanges 80 along a substantial length of the transverse front edge 78 of the clamping member 70. The two oppositely disposed transverse flanges 80 may be inclined forwardly to form a transverse groove at the transverse front edge 78 of the clamping member, which groove is engageable with the transverse rod 60 of the mop frame 10. This feature forces the mop strips 6 to bend forwardly from both sides of the transverse rod 60 as this is desirable for mopping, and further prevents the mop strips 6 from winding back to the mop frame 10 or the clamping member 70.

Preferably, there is a side groove 86 provided at the first side edge 82 of the clamping member 70 to accommodate the first side rod 40, and a side groove 88 provided at the second side edge 84 of the clamping member 70 to accommodate the second side rod 50. As the clamping member 70 is slidably mounted on the central shank 30, the first side rod 40 is slidably engaged into the first side groove 86 of the clamping member 70, and the second side rod 50 is slidably engaged into the second side groove 88 of the clamping member 70. Therefore the clamping member 70 can only slide but not rotate on the central shank 30. This means that the clamping member 70 will always be kept in alignment with the first side rod 40, the second side rod 50 and the transverse rod 60. In other words, the clamping member 70 will always be kept in the same plane with the mop holder frame 10. This feature ensures the proper alignment of the front edge 78 of the clamping member 70 and the transverse rod 60, which in turn ensures the stable clamping of the mop 6.

As previously discussed, the front portion 46 adjacent to the front end 44 of the first side rod 40 is made parallel to the central shank 30, and the front portion 56 adjacent to the front end 54 of the second side rod 50 is also made parallel to the central shank 30. This means that the front portion 46 of the first side rod 40 and the front portion 56 of the second side rod 50 are both perpendicular to the transverse rod 60. The purpose of this feature is that, since now the first side rod 40 regulates the movement of the first side edge 82 of the clamping member 70 through its first side groove 86, and the second side rod 50 regulates the movement of the second side edge 84 of the clamping member 70 through its second side groove 88, this feature ensures that when the clamping member 70 is sliding rearwardly, it can slide freely. However, it will be appreciated that the same objective may be achieved by other arrangement. For example, if the first and second side rods 40 and 50 are obliquely straight throughout their lengths, then making the first and second side grooves 86 and 88 of the clamping member 70 deeper also will allow the clamping member 70 to travel freely.

Referring to FIGS. 3–6, there is shown at 90 the present invention improved slidable and treadable quick release locking nut. The present invention quick release locking nut is generally cylindrical shaped. It has a central slot 92 for accommodating the central shank 30, and a side slot 94 for accommodating a pawl 100. A thin wall 96 is disposed between the central slot 92 and the side slot 94 to divide them partially, so the side slot 94 is connected partially with the central slot 92. There is an annular groove 98 provided at the outer sidewall of the quick release locking nut 90 that enables the user to handle the quick release locking nut 90 more easily. Now also referring to FIGS. 7–9, the pawl 100 has a generally Z-shaped body 102 that has an inwardly protruded tip 104 and an outwardly extended tail 106. The tip 104 is provided with inner screw threads 108. Now further referring to FIGS. 10 and 11, in conjunction with FIGS. 3 through 9, the pawl 100 is pivotally mounted in the side slot 94 by a roll pin 110 and biased by a coil spring 120. There are two aligned holes 112 and 114 on the banks of the side slot 94 of the quick release locking nut, and a hole 116 on the pawl 100, all for receiving the roll pin 110. In addition, there is an outward facing recess 122 provided on the dividing wall 96 of the quick release locking nut 90, and an inward facing recess 124 provided on the pawl 100, for adapting the coil spring 120. As the pawl 100 is pivoted in the side slot 94 of the quick release locking nut by the roll pin 110, it is biased by the coil spring 120 such that its Z-shaped body 102 rotates in a direction where its tip 104 is extending into the central slot 92 of the quick release locking nut and its tail 106 is extending out of the side slot 94 of the quick release locking nut 90.

The quick release locking nut 90 is a self-contained unit wherein the pawl and the spring 120 are securely attached to the quick release locking nut 90 even when the quick release locking nut 90 is not mounted on the central shank 30. The width of the pawl 100 is about the same as the width of the side slot 94, so that when the spring 120 is installed in the side slot 94 of the quick release locking nut 90, it is not exposed to outside of the quick release locking nut 90. This feature prevents the elongated flexible mop strips from becoming entangled with the spring 120, when the mop is in use or is being washed.

As the quick release locking nut 90 is mounted on the central shank 30, its locking mechanism works as follows. As shown in FIGS. 1 and 10, when the tail 106 of the pawl 100 is pressed against the coil spring 120, the body 102 of the pawl 100 rotates in the clockwise direction, and the tip 104 of the pawl 100 is disengaged from the central shank 30, which allows the quick release locking nut to slide freely on the central shank 30. As the quick release locking nut 30 is slid rearwardly towards the base 20, the clamping member 70 can be slid in the same direction, so that the mop clamp constituted by the transverse edge 78 of the movable clamping member 70 and the fixed transverse rod 60 is released, and a user can install or remove a mop. Because both the quick release locking nut 90 and the clamping member 70 are slidable on the central shank 30 as the pawl 100 is pressed, releasing the mop clamp becomes a very quick operation. In addition, as the clamping member is moved rearwardly, the user can quickly detach the second end 64 of the transverse rod 60 from the front end 54 of the second side rod 50 to have the mop 6 easily installed or removed, or to have the clamping member 70 and the quick release locking nut 90 easily assembled onto or dissembled from the central rod 30.

As shown in FIGS. 2 and 11, after the mop 6 is installed, the clamping member 70 is slid forwardly towards the transverse rod 60 to clamp the mop 6, the quick release locking nut 90 is also slid forwardly to rest on the rear edge 72 of the clamping member 70, and the tail 106 of the pawl 100 is released. As the tail 106 of the pawl 100 is not pressed, the body 102 of the pawl 100 will be biased by the coil spring 120 and rotate in the counter-clockwise direction, such that the inner screw threads 108 on the tip 104 of the pawl 100 will engage with the outer screw threads 36 on the central shank 30, which prevents the quick release locking nut 90 from sliding on the central shank 30, which in turn prevents the clamping member from sliding on the central shank 30, so that the mop clamp constituted by the transverse edge 78 of the movable clamping member and the fixed transverse rod 60 is fastened. Moreover, as the inner screw threads 108 on the tip 104 of the pawl 100 are engaged with the outer screw threads 36 on the central shank 30, the quick release locking nut 90 can be further threaded on the central shank 30 to precisely adjust the tightness of the mop clamp.

The mop holder may be made of any suitable material. Preferably it is made of metal materials such as aluminum. The various members of the mop holder, such as the base and the clamping member, may be made of different materials and have respective additional apertures in various shapes and at various locations, for reducing the weight of the mop holder and the cost of manufacture. For example the quick release locking nut may be made of hard molded plastic, and may further have extra eccentric slots for reducing its weight. In addition, the various parts of the mop holder may have other suitable configurations. Furthermore, it will be appreciated that the mop holder can hold other types of cleaning heads, and thus be utilized in various cleaning utility tools. For example, the mop holder may also be used to hold a cleaning brush, or a cleaning sponge, between the transverse rod 60 and the clamping member 70.

The critical difference between the present invention mop holder and prior art mop holders is the use of the quick release locking nut. The quick change type of prior art mop holders have used the wing nut as the releasing and locking member. The major disadvantage of the wing nut is that it has to be rotated many turns for traveling a required distance along the central threaded shank to release or fasten the clamping member. This not only slows down the process of installing or replacing a mop, but also makes it hard to use for people having little strength in their hands, especially elderly people. The present invention solves this problem by providing a quick release locking nut which can be both rotated and slid on the central threaded shank.

The critical difference between the present invention quick release locking nut and prior art quick nut is that the present invention quick release locking nut is specially designed and constructed for mop holders. Being used on a mop holder there are many special concerns which need to be addressed. For example, the elongated flexible mop strips can easily become entangled with the parts of the mop holder when the mop is in use or is being washed. Prior art quick nuts were not designed to be used on mop holders and failed to address the above concerns. The present invention quick release locking nut has a unique cylindrical shaped body to facilitate a user in gripping the locking member easily. The cylindrical shaped body further has an annular outer groove to facilitate a user in gripping the locking member firmly. When the user places his or her fingers in the annular groove of the quick release locking nut and slides it along the central threaded shank, the quick release locking nut will not slip relative to the user's fingers. Therefore, the unique cylindrical shaped body and the outer annular groove makes the present invention improved quick release locking nut much easier for a user to handle, either in rotating it about or sliding it along the central threaded shank.

The present invention has many advantageous features, including: (a) it does not utilize any hard-to-operate lever member, so that it is especially suitable for people with less strength in their hands, such as elderly people; (b) it does not mount any fastening or locking mechanism members onto the mop stick, so that it can be independently manufactured, transported and stored, and interchangeably used with any type of standard mop stick; (c) the slidable attachment of the clamping member and the quick release locking nut enables quick fastening and releasing of the mop clamp; (d) the spring biased pawl offers secured locking of the quick release locking nut, which in turn securely prevents the clamping member from sliding on the central shank; (e) the quick release locking nut can further be threaded on the central shank, which provides a fine adjustment of the tightness of the mop clamp; (f) the transverse rod can never be lost because one of its end is always hingeably attached while the other end can be conveniently detached for various purposes; (g) the mop can be easily installed onto or removed from the mop holder; and (h) the clamping member and the quick release locking nut can be easily assembled onto or dissembled from the central rod for cleaning or maintenance purposes. In addition, it has a strong but light weighted construction, and is simple and inexpensive to produce, and easy and durable to use.

Defined in detail, the present invention is an improved mop holder for holding a mop which is made of a plurality of elongated flexible strips, comprising: (a) a base for adapting a mop stick; (b) a central shank attached to and extending forwardly from said base and having outer screw threads; (c) two oppositely disposed side rods each having a front end and a rear end, and each attached to said base at its respective rear end and extending from said base forwardly and outwardly beyond said central shank; (d) a transverse rod serving as a fixed member of a mop clamp and having one end hingeably attached to said front end of one of said two side rods and the opposite end releasably attached to said front end of the other one of said two side rods; (e) a clamping member having a central slot for slidably mounting it on said central shank, two oppositely disposed side grooves for slidable engagement with said two side rods respectively at portions adjacent to their respective front ends, and a transverse edge serving as a movable member of said mop clamp; (f) a quick release locking nut having a generally cylindrical shaped body, the cylindrical body having a central slot for slidably mounting it on said central shank and a side slot interconnecting the central slot, the cylindrical body further having an annular outer groove so that a user can grip the quick release locking nut firmly to slide or rotate it; (g) a pawl pivotally mounted in said side slot of said quick release locking nut and having a tip with inner screw threads; (h) a coil spring biasing said tip of said pawl to engage it onto said central shank, the coil spring being installed in said side slot and not exposed to outside of said body of said quick release locking nut to thereby prevent said elongated flexible mop strips from becoming entangled with the coil spring when said mop is in use or is being washed; (i) said quick release locking nut being a self-contained unit wherein said pawl and said coil spring are securely attached to said body of said quick release locking nut even when said quick release locking nut is not mounted on said central shank; (j) a thin wall disposed between said central slot and said side slot to divide them partially, so that said side slot is connected partially with said central slot; (k) said thin wall disposed between said central slot and said side slot has an outward facing recess for adapting one end of said biasing spring; and (l) said pawl has an inward facing recess located remote from said tip for adapting an opposite end of said biasing spring; (m) whereby when said pawl is pressed against said spring and its tip is disengaged from said central shank, said quick release locking nut is unlocked and can be slid on said central shank for allowing said clamping member to slide on said central shank so that said mop clamp can be released, and said transverse rod can be further detached at its releasably attached end, and when said pawl is biased by said spring and its tip is engaged to said central shank, said quick release locking nut is locked on said central shank for preventing said clamping member from sliding on said central shank so that said mop clamp can be fastened, and said quick release locking nut can be further threaded on said central shank to precisely adjust the tightness of said mop clamp.

Defined broadly, the present invention is an improved quick release locking nut for a mop holder which is used for holding a mop which is made of a plurality of elongated flexible strips, where the mop holder includes a frame having a base for adapting a mop stick, a central shank having outer screw threads and extending forwardly from the base, two oppositely disposed side walls extending from the base forwardly and outwardly beyond the central shank and supporting a transverse wall which serves as a fixed member of a mop clamp, a clamping member slidably mounted on the central shank and having a transverse edge which serves as a movable member of the mop clamp, the quick release locking nut comprising: (a) a generally cylindrical shaped body with an annular outer groove so that a user can grip the quick release locking nut firmly to slide or rotate it; (b) a central slot for slidable engagement on said central shank; (c) a pawl pivotally mounted to said quick release locking nut and biased by a spring such that its tip is engaged onto said central shank, the spring being installed in a side slot of said quick release locking nut and not exposed to outside of said quick release locking nut to prevent said elongated flexible mop strips from becoming entangled with the spring when said mop is in use or is being washed; (d) said tip of said spring biased pawl further having inner screw threads; (e) a thin wall disposed between said central slot and said side slot to divide them partially, so that said side slot is connected partially with said central slot; (f) said quick release locking nut being a self-contained unit wherein said pawl and said spring are securely attached to said quick release locking nut even when said quick release locking nut is not mounted on said central shank; (g) said thin wall disposed between said central slot and said side slot has an outward facing recess for adapting one end of said biasing spring; and (h) said pawl has an inward facing recess located remote from said tip for adapting an opposite end of said biasing spring; (i) whereby when said pawl is pressed against said spring and its tip is disengaged from said central shank, said quick release locking nut is unlocked and can be slid on said central shank for allowing said clamping member to slide on said central shank so that said mop clamp can be released, and when said pawl is biased by said spring and its tip is engaged to said central shank, said quick release locking nut is locked on said central shank for preventing said clamping member from sliding on said central shank so that said mop clamp can be fastened, and said quick release locking nut can be further threaded on said central shank to precisely adjust the tightness of said mop clamp.

Defined more broadly, the present invention is an improved quick release locking nut for a mop holder which is used for holding a mop which is made of a plurality of elongated flexible strips, where the mop holder includes a frame having a base for adapting a mop stick, a central shank having outer screw threads and extending forwardly from the base, two oppositely disposed side walls extending from the base forwardly and outwardly beyond the central shank and supporting a transverse wall which serves as a fixed member of a mop clamp, a clamping member slidably mounted on the central shank and having a transverse edge which serves as a movable member of the mop clamp, the quick release locking nut comprising: (a) a nut body with an annular outer groove so that a user can grip the quick release locking nut firmly to slide or rotate it; (b) a central slot for slidable engagement on said central shank; (c) a pawl pivotally mounted to said quick release locking nut and biased by a spring such that its tip is engaged onto said central shank, the spring being installed in a side slot of said quick release locking nut and not exposed to outside of said quick release locking nut to prevent said elongated flexible mop strips from becoming entangled with the spring when said mop is in use or is being washed; (d) said tip of said spring biased pawl further having inner screw threads; (e) a thin wall disposed between said central slot and said side slot to divide them partially, so that said side slot is connected partially with said central slot; and (f) said quick release locking nut being a self-contained unit wherein said pawl and said spring are securely attached to said quick release locking nut even when said quick release locking nut is not mounted on said central shank; (g) whereby when said pawl is pressed against said spring and its tip is disengaged from said central shank, said quick release locking nut is unlocked and can be slid on said central shank for allowing said clamping member to slide on said central shank so that said mop clamp can be released, and when said pawl is biased by said spring and its tip is engaged to said central shank, said quick release locking nut is locked on said central shank for preventing said clamping member from sliding on said central shank so that said mop clamp can be fastened, and said quick release locking nut can be further threaded on said central shank to precisely adjust the tightness of said mop clamp.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An improved quick release locking nut for mop holder which is used for holding a mop which is made of a plurality of elongated flexible strips, where the mop holder includes a frame having a base for adapting a mop stick, a central shank having outer screw threads and extending forwardly from the base, two oppositely disposed side walls extending from the base forwardly and outwardly beyond the central shank and supporting a transverse wall which serves as a fixed member of a mop clamp, a clamping member slidably mounted on the central shank and having a transverse edge which serves as a movable member of the mop clamp, the quick release locking nut comprising:

a. a nut body with an annular outer groove so that a user can grip the quick release locking nut firmly to slide or rotate it;

b. a central slot for slidable engagement on said central shank;

c. a pawl pivotally mounted to said quick release locking nut and biased by a spring such that its tip is engaged onto said central shank, the spring being installed in a side slot of said quick release locking nut and not exposed to outside of said quick release locking nut to prevent said elongated flexible mop strips from becoming entangled with the spring when said mop is in use or is being washed;

d. said tip of said spring biased pawl further having inner screw threads;

e. a thin wall disposed between said central slot and said side slot to divide them partially, so that said side slot is connected partially with said central slot; and f. said quick release locking nut being a self-contained unit wherein said pawl and said spring are securely attached to said quick release locking nut even when said quick release locking nut is not mounted on said central shank;

g. whereby when said pawl is pressed against said spring and its tip is disengaged from said central shank, said quick release locking nut is unlocked and can be slid on said central shank for allowing said clamping member to slide on said central shank so that said mop clamp can be released, and when said pawl is biased by said spring and its tip is engaged to said central shank, said quick release locking nut is locked on said central shank for preventing said clamping member from sliding on said central shank so that said mop clamp can be fastened, and said quick release locking nut can be further threaded on said central shank to precisely adjust the tightness of said mop clamp.

2. The invention as defined in claim 1 wherein said nut body is generally cylindrical shaped.

3. The invention as defined in claim 1 wherein said spring biased pawl is pivotally mounted to said quick release locking nut by a roll pin.

4. The invention as defined in claim 1 wherein said thin wall disposed between said central slot and said side slot has an outward facing recess for adapting said biasing spring.

5. The invention as defined in claim 1 wherein said pawl has an inward facing recess located remote from said tip for adapting said biasing spring.

6. An improved quick release locking nut for a mop holder which is used for holding a mop which is made of a plurality of elongated flexible strips, where the mop holder includes a frame having a base for adapting a mop stick, a central shank having outer screw threads and extending forwardly from the base, two oppositely disposed side walls extending from the base forwardly and outwardly beyond the central shank and supporting a transverse wall which serves as a fixed member of a mop clamp, a clamping member slidably mounted on the central shank and having a transverse edge which serves as a movable member of the mop clamp, the quick release locking nut comprising:

a. a generally cylindrical shaped body with an annular outer groove so that a user can grip the quick release locking nut firmly to slide or rotate it;

b. a central slot for slidable engagement on said central shank;

c. a pawl pivotally mounted to said quick release locking nut and biased by a spring such that its tip is engaged onto said central shank, the spring being installed in a side slot of said quick release locking nut and not exposed to outside of said quick release locking nut to prevent said elongated flexible mop strips from becoming entangled with the spring when said mop is in use or is being washed;

d. said tip of said spring biased pawl further having inner screw threads;

e. a thin wall disposed between said central slot and said side slot to divide them partially, so that said side slot is connected partially with said central slot;

f. said quick release locking nut being a self-contained unit wherein said pawl and said spring are securely attached to said quick release locking nut even when said quick release locking nut is not mounted on said central shank;

g. said thin wall disposed between said central slot and said side slot has an outward facing recess for adapting one end of said biasing spring; and h. said pawl has an inward facing recess located remote from said tip for adapting an opposite end of said biasing spring;

i. whereby when said pawl is pressed against said spring and its tip is disengaged from said central shank, said quick release locking nut is unlocked and can be slid on said central shank for allowing said clamping member to slide on said central shank so that said mop clamp can be released, and when said pawl is biased by said spring and its tip is engaged to said central shank, said quick release locking nut is locked on said central shank for preventing said clamping member from sliding on said central shank so that said mop clamp can be fastened, and said quick release locking nut can be further threaded on said central shank to precisely adjust the tightness of said mop clamp.

7. The invention as defined in claim 6 wherein said spring biased pawl is pivotally mounted to said quick release locking nut by a roll pin.

8. The invention as defined in claim 6 wherein said pawl has a generally Z-shaped body having said tip which is inwardly protruding and a widened tail which is outwardly extended.

9. The invention as defined in claim 6 wherein the width of said pawl is about the same as the width of said side slot, so that when said spring is installed in said side slot, it is completely concealed.

10. An improved mop holder for holding a mop which is made of a plurality of elongated flexible strips, comprising:

a. a base for adapting a mop stick;

b. a central shank attached to and extending forwardly from said base and having outer screw threads;

c. two oppositely disposed side rods each having a front end and a rear end, and each attached to said base at its respective rear end and extending from said base forwardly and outwardly beyond said central shank;

d. a transverse rod serving as a fixed member of a mop clamp and having one end hingeably attached to said front end of one of said two side rods and the opposite end releasably attached to said front end of the other one of said two side rods;

e. a clamping member having a central slot for slidably mounting it on said central shank, two oppositely disposed side grooves for slidable engagement with said two side rods respectively at portions adjacent to their respective front ends, and a transverse edge serving as a movable member of said mop clamp;

f. a quick release locking nut having a generally cylindrical shaped body, the cylindrical body having a central slot for slidably mounting it on said central shank and a side slot interconnecting the central slot, the cylindrical body further having an annular outer groove so that a user can grip the quick release locking nut firmly to slide or rotate it;

g. a pawl pivotally mounted in said side slot of said quick release locking nut and having a tip with inner screw threads;

h. a coil spring biasing said tip of said pawl to engage it onto said central shank, the coil spring being installed in said side slot and not exposed to outside of said body of said quick release locking nut to thereby prevent said elongated flexible mop strips from becoming entangled with the coil spring when said mop is in use or is being washed;

i. said quick release locking nut being a self-contained unit wherein said pawl and said coil spring are securely attached to said body of said quick release locking nut even when said quick release locking nut is not mounted on said central shank;

j. a thin wall disposed between said central slot and said side slot to divide them partially, so that said side slot is connected partially with said central slot;

k. said thin wall disposed between said central slot and said side slot has an outward facing recess for adapting one end of said biasing spring; and l. said pawl has an inward facing recess located remote from said tip for adapting an opposite end of said biasing spring;

m. whereby when said pawl is pressed against said spring and its tip is disengaged from said central shank, said quick release locking nut is unlocked and can be slid on said central shank for allowing said clamping member to slide on said central shank so that said mop clamp can be released, and said transverse rod can be further detached at its releasably attached end, and when said pawl is biased by said spring and its tip is engaged to said central shank, said quick release locking nut is locked on said central shank for preventing said clamping member from sliding on said central shank so that said mop clamp can be fastened, and said quick release locking nut can be further threaded on said central shank to precisely adjust the tightness of said mop clamp.

11. The invention as defined in claim 10 wherein said base comprises a rearwardly elongated tubular portion for accommodating said mop stick.

12. The invention as defined in claim 10 wherein said two oppositely disposed side rods each have a front portion adjacent to its respective front end which is perpendicular to said transverse rod.

13. The invention as defined in claim 10 wherein said clamping member is generally triangular shaped.

14. The invention as defined in claim 10 wherein said transverse edge of said clamping member is widened for accommodating a mop attachment.

15. The invention as defined in claim 10 wherein said quick release locking nut is generally cylindrical shaped.

16. The invention as defined in claim 10 wherein said quick release locking nut is mounted on said central shank between said clamping member and said base.

17. The invention as defined in claim 10 wherein said spring biased pawl is pivotally mounted in said side slot of said quick release locking nut by a roll pin.

18. The invention as defined in claim 17 wherein said nut body is further provided with two aligned holes respectively on two opposite banks of said side slot for accommodating said roll pin.

19. The invention as defined in claim 10 wherein said pawl has a generally Z-shaped body having said tip which is inwardly protruding and a widened tail which is outwardly extended.

20. The invention as defined in claim 10 wherein the width of said pawl is about the same as the width of said side slot, so that when said spring is installed in said side slot, it is completely concealed.

* * * * *